US007311097B1

(12) United States Patent
Callis

(10) Patent No.: US 7,311,097 B1
(45) Date of Patent: Dec. 25, 2007

(54) BOW CONSTRUCTION INCLUDING A TELESCOPING BOW RISER AND GROUND SUPPORT

(76) Inventor: Brad Callis, 2955 Morton Ridge Rd., Bedford, KY (US) 40006

( * ) Notice: Subject to any disclaimer, the term of this patent is extended or adjusted under 35 U.S.C. 154(b) by 235 days.

(21) Appl. No.: 11/006,091

(22) Filed: Dec. 7, 2004

(51) Int. Cl.
*F41B 5/00* (2006.01)

(52) U.S. Cl. ..... 124/23.1; 124/86

(58) Field of Classification Search ..... 124/23.1, 124/25.6, 86, 88; 248/156
See application file for complete search history.

(56) References Cited

U.S. PATENT DOCUMENTS

| | | | | |
|---|---|---|---|---|
| 1,564,089 | A * | 12/1925 | Maxwell | 124/24.1 |
| 3,584,820 | A | 6/1971 | Butcher, Sr. | 248/122 |
| 3,667,444 | A | 6/1972 | Depatie et al. | 124/24 |
| 3,855,991 | A | 12/1974 | Imatt et al. | 124/24 R |
| 3,991,780 | A * | 11/1976 | Maroski, Jr. | 135/66 |
| 4,846,140 | A | 7/1989 | DiMartino | 248/360 |
| 5,048,504 | A | 9/1991 | Ballard | 124/86 |
| 5,111,800 | A | 5/1992 | Reynolds | 124/88 |
| 5,240,211 | A * | 8/1993 | Anderson | 248/125.3 |
| 5,619,981 | A * | 4/1997 | Breedlove | 124/89 |
| 5,904,134 | A * | 5/1999 | Denbow | 124/89 |
| 6,726,160 | B1 * | 4/2004 | Buchanan, Jr. | 248/156 |
| 6,749,170 | B1 * | 6/2004 | Rhoads | 248/545 |
| 6,948,694 | B1 * | 9/2005 | Gilbert | 248/530 |

* cited by examiner

*Primary Examiner*—John A. Ricci
(74) *Attorney, Agent, or Firm*—Sturm & Fix LLP

(57) ABSTRACT

A bow construction (10) adapted for use in combination with a wheelchair (200) wherein the bow construction (10) includes a hollow cylindrical riser member (20) provided with a pair of bow limb members (30) and a pair of transverse tubular elements (24) (25) that serve as a bow rest and bow sight respectively; wherein, the bow riser member (20) is slidably disposed on and vertically adjustable with respect to an elongated cylindrical spike member (40) that is adapted to be releaseably attached to one of the foot rests (201) of a wheelchair (200).

14 Claims, 2 Drawing Sheets

BOW CONSTRUCTION INCLUDING A TELESCOPING BOW RISER AND GROUND SUPPORT

CROSS REFERENCE TO RELATED APPLICATIONS

Not applicable.

BACKGROUND OF THE INVENTION

1. Field of the Invention

The present invention relates to the field of archery bows in general and in particular to an archery bow having a riser that telescopically receives a ground support that is adapted to be connected to a wheelchair.

2. Description of Related Art

As can be seen by reference to the following U.S. patent Nos. the prior art is replete with myriad and diverse bow support arrangements for maintaining a bow in a vertically upright position.

While all of the aforementioned prior art constructions are more than adequate for the basic purpose and function for which they have been specifically designed, they are uniformly deficient with respect to their failure to provide a simple, efficient, and practical bow having a combined riser and ground support unit that not only provides a point of attachment for a pair of bow limbs, but which also has a variety of common archery accessories deployed in a rather unique fashion due to the innovative construction of the combined riser and ground support.

In addition, as most physically challenged archers and bow hunters are all too well aware, the most common difficulty that they encounter in the pursuit of their sport is the task of holding and maintaining a bow in a vertically upright, steady position while aiming, drawing and releasing the bow.

As a consequence of the foregoing situation, there has existed a longstanding need, specifically among the physically challenged, for a new and improved archery bow construction that employs an integral bow riser and ground support whereby the user can quickly adjust the effective length of the ground support to vary the point of impact of an arrow shot from the bow; and, the provision of such a bow construction is the stated objective of the present invention.

BRIEF SUMMARY OF THE INVENTION

Briefly stated, the bow construction that forms the basis of the present invention comprises in general a riser unit supporting a pair of limb units and diverse archery accessories wherein, the riser unit also telescopically receives an extensible length ground engaging support unit and can be adjusted upwardly or downwardly relative to the support unit to vary the point of impact of an arrow propelled by the bow construction.

As will be explained in greater detail further on in the specification, the riser unit comprises an elongated hollow cylindrical riser member which supports a pair of limb units operatively associated with a bow string for propelling an arrow toward a target wherein the intermediate portion of the riser member is further provided with a pair of transverse tubular elements that function as an arrow rest and bow sight.

In addition, the riser unit is adapted to be slidably and adjustably received relative to the support unit that includes an elongated cylindrical pike member having a pointed lower end adapted to penetrate the ground as well as a wheelchair adapter member that is releasably engagable with the footrest portion of a wheelchair.

Furthermore, the cylindrical spike member is also provided with a quiver member that is adapted to suspend and support a plurality of arrows in close proximity to both the riser member and the occupant of the wheelchair.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
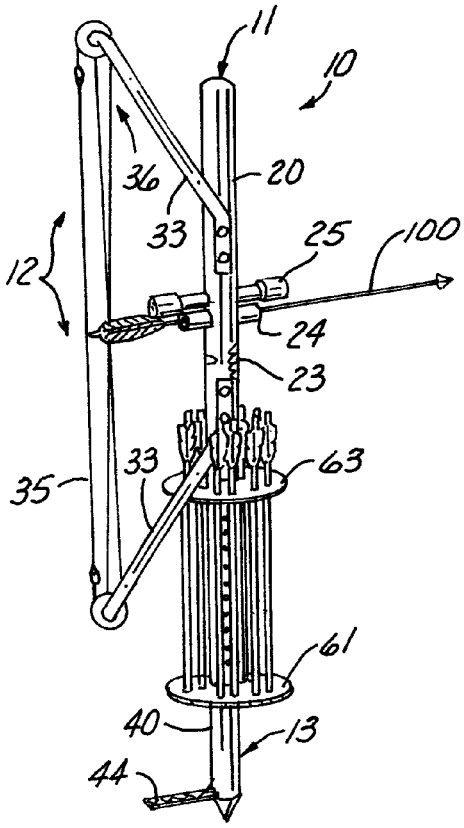
FIG. 1 is a perspective view of the preferred embodiment of the bow construction.

As can be seen by reference to the drawings, and in particularly to FIG. 1, the bow construction that forms the basis of the present invention is designated generally by the reference number 10. The bow construction 10 comprises in general a riser unit 11, a pair of limb units 12, and a ground support unit 13. These units will now be described in seriatim fashion.

Figure 2:
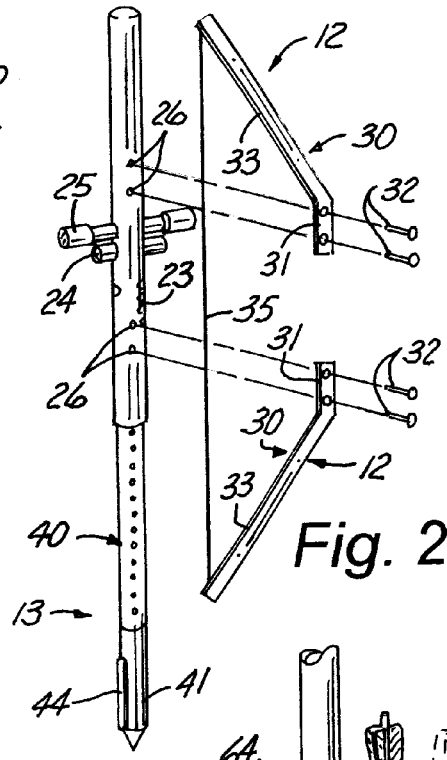
FIG. 2 is an exploded perspective view showing the relationship between the pair of bow limbs and the riser unit.
Figure 6:
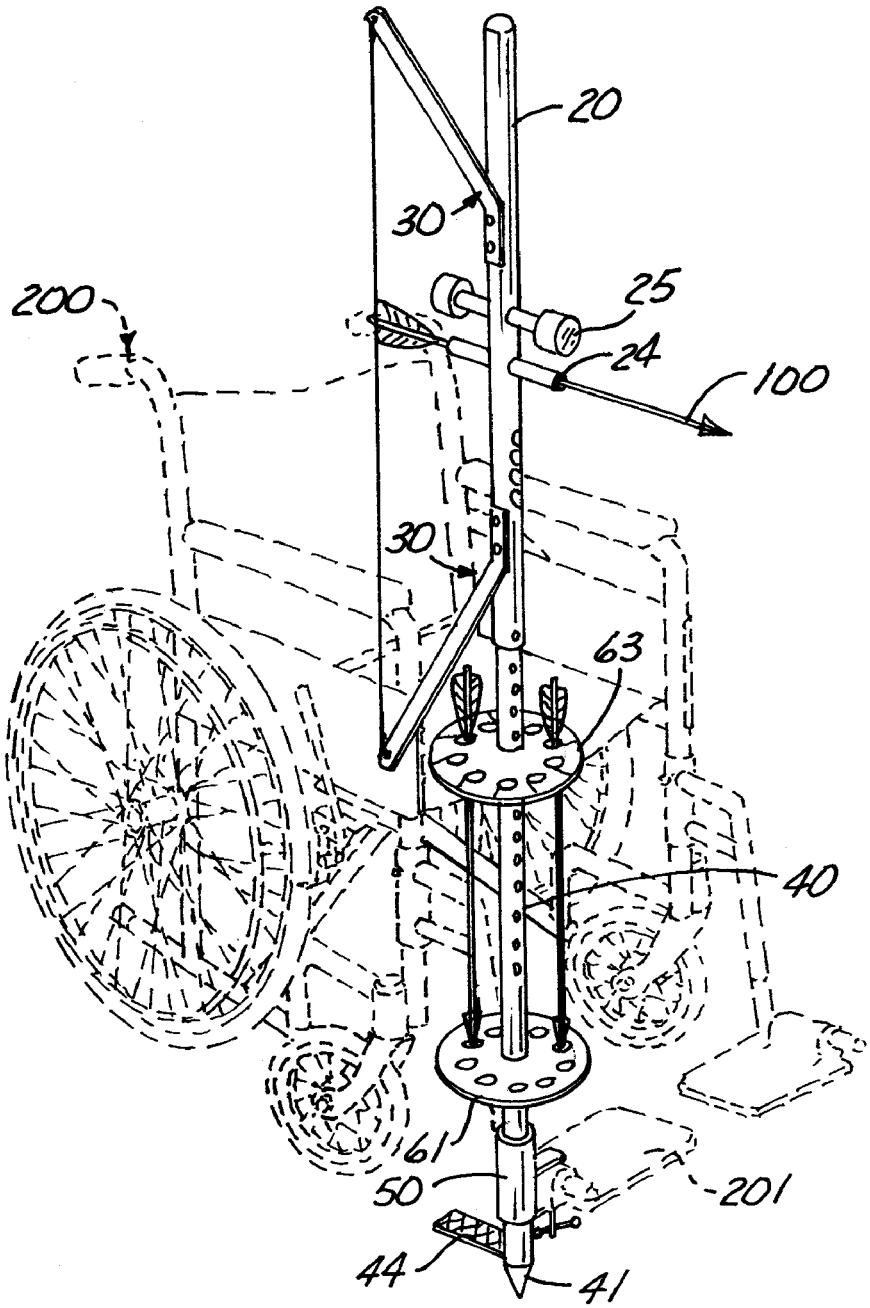

As shown, in FIGS. 1, 2, and 6, the riser unit 11 comprises an elongated hollow cylindrical riser member 20 having a closed upper end 21 and an open lower end 22 wherein the intermediate portions of the riser member 20 is provided with a plurality of finger grip recesses or indentations 23 which are disposed beneath a pair of vertically aligned transverse tubular elements 24 25 which pass completely through the interior of the riser member 20; wherein, the lower tubular element 24 is dimensioned to receive the shaft of an arrow 100 and serves as an arrow rest, and the upper tubular element 25 is adapted to receive one or more sight pins (not shown) and functions as a bow sight window.

In addition, the riser member 20 is further provided with a plurality of vertically aligned mounting apertures 26 that are offset 900 from the longitudinal axis of the aligned tubular elements 24 25 for reasons that will be explained presently.

As can best be appreciated by reference to FIGS. 1 and 2, the pair of limb units 12 each comprises a bow limb member 30 having a vertically disposed mounting foot 31 provided with apertures that are adapted to receive conventional fasteners 32 for securing the mounting feet 31' 31 to the riser member 20 via the mounting apertures 26 that are disposed both above and below the pair of tubular elements 24 25.

Furthermore, each of the bow limb members 30 includes an elongated deformable bow limb arm 33 extending rearwardly from each of the mounting feet 31 respectively wherein, the outboard end of each limb arm 33 is operatively associated with a portion of a bow string 35 which may optionally also be associated with a cam and cable assembly 36 as shown in FIG. 1.

Figure 3:
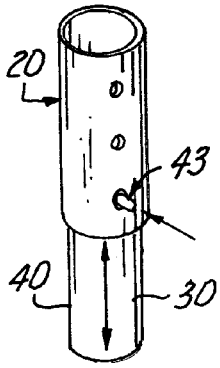
FIG. 3 is an isolated detail showing the telescoping engagement between the riser unit and the ground engaging unit.
Figure 5:
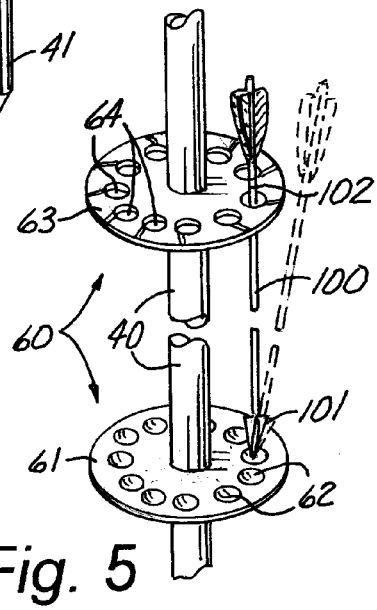
FIG. 5 is an isolated detail view of the specialized arrow quiver employed on the bow construction; and, FIG. 6 is an enlarged perspective view showing the bow construction operatively associated with a wheelchair.

Turning now to FIGS. 2, 3, and 5, it can be seen that the ground support unit 13 comprises an elongated cylindrical spike member 40 dimensioned to be slidably received within the hollow riser member 20 wherein, the lower end of the spike member is provided with a ground penetrating point 41 and the upper portion of the spike member 40 is provided with one portion of a cooperating aperture and detent arrangement designated generally as 43.

As can best be appreciated by reference to FIGS. 1,2, and 6, the lower portion of the spike member 40 is further provided with a hinged stabilizing foot 44 that can fold down to both assist in driving the spike member 40 into the ground, as well as to stabilize the spike member 40 in a vertically upright position when the spike member 40 is properly installed.

Figure 4:
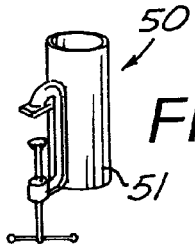
FIG. 4 is an isolated detail view of a wheelchair adapter for the ground engaging unit.

In addition, as shown in FIGS. 4 and 6, the bow construction 10 of this invention is specifically designed for attachment to a wheelchair 200 via a wheelchair adapter member 50 that includes a cylindrical collar element 51 dimensioned to frictionally engage the lower portion of the cylindrical spike member 40 wherein the cylindrical collar element 51 is further provided with an axially offset clamp 52 that is fixedly secured to the collar element 51 and adapted to releasably engage one of the footrests 201 of the wheelchair 200 such that the spike member 40 has a three point stabilizing arrangement that maintains the riser member 20 in a vertically upright position.

Turning now to FIGS. 1, 5, 6, it can be seen that the spike member 40 is further provided with a quiver member 60 that includes a lower disk element 61 provided with a plurality of recesses 61 dimensioned to receive and support broadheads or field tips 101 and an upper disk element 62 provided with a plurality of contoured slots 64 adapted to releasably engage the upper portion of the shafts 102 of the arrows 100 in a well recognized manner.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A bow construction for physically challenged archers and bow hunters confined to a wheelchair wherein the bow construction comprises:

a riser unit including an elongated hollow cylindrical riser member having an open lower end;

a pair of limb units wherein each limb unit comprises a contoured bow limb member having one end connected to the riser member and the other end associated with a portion of a bowstring;

a support unit including an elongated spike member adapted to be slidably received within the open lower end of the riser member;

means for adjusting the vertical position of the riser member relative to the spike member; and means for releasably securing the spike member to a portion of a wheelchair.

2. The bow construction as in claim 1; wherein, the spike member has a lower end provided with a ground penetrating point.

3. The bow construction as in claim 2; wherein, the lower end of the spike member is further provided with a hinged stabilizing foot.

4. The bow construction as in claim 3; wherein, the spike member is further provided with a quiver member including an upper disk element provided with a plurality of contoured slots adapted to releasably receive the shafts of a plurality of arrows and a lower disk element provided with a plurality of recesses adapted to support the tips of a plurality of arrows.

5. The bow construction as in claim 2; wherein, the spike member is further provided with a quiver member including an upper disk element provided with a plurality of contoured slots adapted to releasably receive the shafts of a plurality of arrows and a lower disk element provided with a plurality of recesses adapted to support the tips of a plurality of arrows.

6. The bow construction as in claim 1; wherein, the spike member has a lower end provided with a ground penetrating point.

7. The bow construction as in claim 1; wherein, the lower end of the spike member is further provided with a hinged stabilizing foot.

8. The construction as in claim 1; wherein, the spike member is further provided with a quiver member including an upper disk element provided with a plurality of contoured slots adapted to releasably receive the shafts of a plurality of arrows and a lower disk element provided with a plurality of recesses adapted to support the tips of a plurality of arrows.

9. The bow construction as in claim 1; wherein, the spike member is further provided with a quiver member including an upper disk element provided with a plurality of contoured slots adapted to releasably receive the shafts of a plurality of arrows and a lower disk element provided with a plurality of recesses adapted to support the tips of a plurality of arrows.

10. A bow construction for physically challenged archers and bow hunters confined to a wheelchair wherein the bow construction comprises:

a riser unit including an elongated hollow cylindrical riser member having an open lower end;

a pair of limb units wherein each limb unit comprises a contoured bow limb member having one end connected to the riser member and the other end associated with a portion of a bowstring;

a support unit including an elongated spike member adapted to be slidably received within the open lower end of the riser member;

means for adjusting the vertical position of the riser member relative to the spike member;

wherein, the spike member has a lower end provided with a ground penetrating point; and wherein, the lower end of the spike member is further provided with a hinged stabilizing foot.

11. A bow construction for physically challenged archers and bow hunters confined to a wheelchair wherein the bow construction comprises a riser unit including an elongated hollow cylindrical riser member having an open lower end a pair of limb units wherein each limb unit comprises a contoured bow limb member having one end connected to the riser member and the other end associated with a portion of a bowstring; and a support unit including an elongated spike member adapted to be slidably received within the open lower end of the riser member; wherein, the spike member is further provided with a quiver member including an upper disk element provided with a plurality of contoured slots adapted to releasably receive the shafts of a plurality of arrows and a lower disk element provided with a plurality of recesses adapted to support the tips of a plurality of arrows.

12. A bow construction for physically challenged archers and bow hunters confined to a wheelchair wherein the bow construction comprises:

a riser unit including an elongated hollow cylindrical riser member having an open lower end;

a pair of limb units wherein each limb unit comprises a contoured bow limb member having one end connected to the riser member and the other end associated with a portion of a bowstring;

a support unit including an elongated spike member adapted to be slidably received within the open lower end of the riser member;

wherein, the riser member is further provided with at least one transverse tubular element disposed perpendicular to the longitudinal axis of the riser member; and wherein, said at least one transverse tubular element is dimensioned to slidably receive the shaft of an arrow.

13. A bow construction for physically challenged arches and bow hunters confined to a wheelchair wherein the bow construction comprises:

a riser unit including an elongated hollow cylindrical member having an open lower end;

a pair of limb units wherein each limb unit comprises a contoured bow limb member having one end connected to the riser member and the other end associated with a portion of a bowstring;

a support unit including an elongated spike member adapted to be slidable received within the open lower end of the riser member;

wherein, the riser member is further provided with at least one transverse tubular element disposed perpendicular to the longitudinal axis of the riser member; and wherein, said at least one transverse tubular element is adapted to function as a bow sight.

14. A bow construction for physically challenged archers and bow hunters confined to a wheelchair wherein the bow construction comprises a riser unit including an elongated hollow cylindrical riser member having an open lower end a pair of limb units wherein each limb unit comprises a contoured bow limb member having one end connected to the riser member and the other end associated with a portion of a bowstring; and a support unit including an elongated spike member adapted to be slidably received within the open lower end of the riser member; and wherein, the riser member is further provided with a pair of vertically spaced tubular elements disposed perpendicular to the longitudinal axis of the riser member; wherein, the lower transverse tubular element functions as an arrow rest and the upper transverse tubular element functions as a bow sight.

* * * * *